US006478689B1

(12) United States Patent
Hisamatsu

(10) Patent No.: US 6,478,689 B1
(45) Date of Patent: Nov. 12, 2002

(54) GOLF CLUB AND SET OF GOLF CLUBS

(75) Inventor: Goro Hisamatsu, Gifu (JP)

(73) Assignee: Nizunot Corporation, Osaka (JP)

( * ) Notice: Subject to any disclaimer, the term of this patent is extended or adjusted under 35 U.S.C. 154(b) by 0 days.

(21) Appl. No.: 09/716,578

(22) Filed: Nov. 20, 2000

(30) Foreign Application Priority Data

Dec. 17, 1999 (JP) ..... 11-358780

(51) Int. Cl.[7] ..... A63B 53/00
(52) U.S. Cl. ..... 473/287; 473/292; 473/319
(58) Field of Search ..... 473/292, 316–320; 428/36.3, 36.9; 264/635; 156/187, 188

(56) References Cited

U.S. PATENT DOCUMENTS 5,467,984 A 11/1995 Veux et al.
5,569,097 A * 10/1996 Veux
5,700,533 A * 12/1997 You
5,944,618 A * 8/1999 Cheng
6,306,047 B1 * 10/2001 Kusumoto

* cited by examiner

*Primary Examiner*—Stephen Blau
(74) *Attorney, Agent, or Firm*—Troutman Sanders LLP; Gerald R. Boss; Ryan A. Schneider

(57) ABSTRACT

A golf club includes a shaft, a head attached to the tip end of the shaft, and a grip attached at the butt end of the shaft. The 14-inch balance is D0 or more. The club has initial velocity per equivalent pendulum length Vb/Lp that is larger than −3.57 Lc+64.58 when Lc represents the club length. The initial velocity Vb is defined as:

$$Vb=1.8\ Mh(56.22\ Lc-35.16\ Mc-39.77\ Lp+31.61)/(Mh+0.0455)$$

where Mh is the mass of the head (kg) and Mc is the total mass of the club.

16 Claims, 4 Drawing Sheets

GOLF CLUB AND SET OF GOLF CLUBS

This application claims priority based on Japanese Patent Application No. 11-358780 filed Dec. 17, 1999 and entitled "Golf Club and Set of Golf Clubs."

BACKGROUND OF THE INVENTION

This invention relates to a golf club that has improved swing characteristics while maintaining the high ball flying distance and to a set of such golf clubs.

A golf club has a head, which strikes balls, a grip, which a golfer holds, and a shaft, which connects the head and the grip. A set of golf clubs generally includes nine or ten "iron" type clubs and some "wood" type clubs. Each of these clubs has a different club length, loft angle, and a head mass to meet requirements such as a flying distance and strike angle. For example, a wedge club, which is suitable to propel a ball short distances, has a club length of about 0.9 meters and a head mass of about 0.29 kilograms. On the other hand, a driver, which is suitable to propel a ball long distances, has a club length of about 1.14 meters and a head mass of about 0.2 kilograms.

Manufacturers of golf clubs continually improve the design of clubs to produce clubs that are easier to swing and that propel balls over greater distances with less work, regardless of above-mentioned differences in characteristics of each club.

The problem that a club having a longer target flying distance (i.e., a smaller club number) is harder to swing and requires more work has not yet been solved. To obtain a greater flying distance, the head should have a higher speed when the head impacts the ball. One of the effective methods of increasing the head speed is to increase the club length (LC). However, if the club length is longer, the mass of the club increases and the equivalent pendulum length (LPE) around the rotation center (upper end of the grip of the club) increases. This increases the work of swinging the club. That is, to increase the ball flying distance by increasing the club length presents a physical contradiction.

To overcome this contradiction, for example, U.S. Pat. No. 5,467,984 discloses a golf club for which the ratio of the equivalent pendulum length to the club length (LPE/LC) is less than 0.87 when the LPE is measured along the axis from the upper end of the grip to 101.6 mm below the upper end. This patent provides a club that has a total mass of less than 340 g and has improved swing characteristics without changing the club length. This is achieved by reducing the mass of the grip and the shaft and by adding a weight, the mass of which is equal to reduced mass of the grip and the shaft, at the middle of the shaft.

The shorter the equivalent pendulum length of the club is, the easier it is to swing the club. There are two most effective methods to shorten the equivalent pendulum length. One is to shorten the club length. The other is to reduce the mass of the head. Both methods have disadvantages. Shortening the club reduces the head speed and thus reduces the flying distance. The small head mass reduces the rebound ratio of the head against the ball. This also reduces the ball flying distance.

Apart from the prior art described above, to shorten the equivalent pendulum length without changing the club length and the head mass, it is most effective to reduce the grip mass and the shaft mass and add a weight, the mass of which is equal to the sum of the reduced mass, at the middle of the shaft. This improves the "feel" of the club. However, the prior art has not yet revealed whether this design alteration is associated with the flying distance, in other words, the prior art does not explain how the head mass and the shaft mass should be determined relative to the club length to maintain the high flying distance.

A golf club that is easy to swing and provides a greater target flying distance with less work and a set of such golf clubs do not existed.

Accordingly, one object of the present invention is to provide a golf club that has improved swing characteristics while maintaining high flying distance with less work by calculating the optimum mass distribution of the club while keeping the club length constant. Also, another object of the present invention is to provide a set of such golf clubs.

SUMMARY OF THE INVENTION

The golf club of the present invention includes a shaft, a head, and a grip. The shaft has a tip end and a butt end. The head is attached to the tip end of the shaft. The grip is attached to the butt end of the shaft. The 14-inch balance of the club is D0 or more. The initial velocity per equivalent pendulum length Vb/Lp larger than −3.57 Lc+64.58 Vb is the initial velocity of the ball. Lp is the equivalent pendulum length of the club when an upper end of the grip is taken as a rotation center. Lc is the club length as measured from the upper end of the grip to a perpendicular projection of the center of gravity of the head along the axis of the shaft. The initial velocity of the ball is:

$$Vb=1.8\ Mh(56.22\ Lc-35.16\ Mc-39.77\ Lp+31.61)/(Mh+0.0455).$$

Mh is the mass of the head (kg) and Mc is the total mass of the club (kg).

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
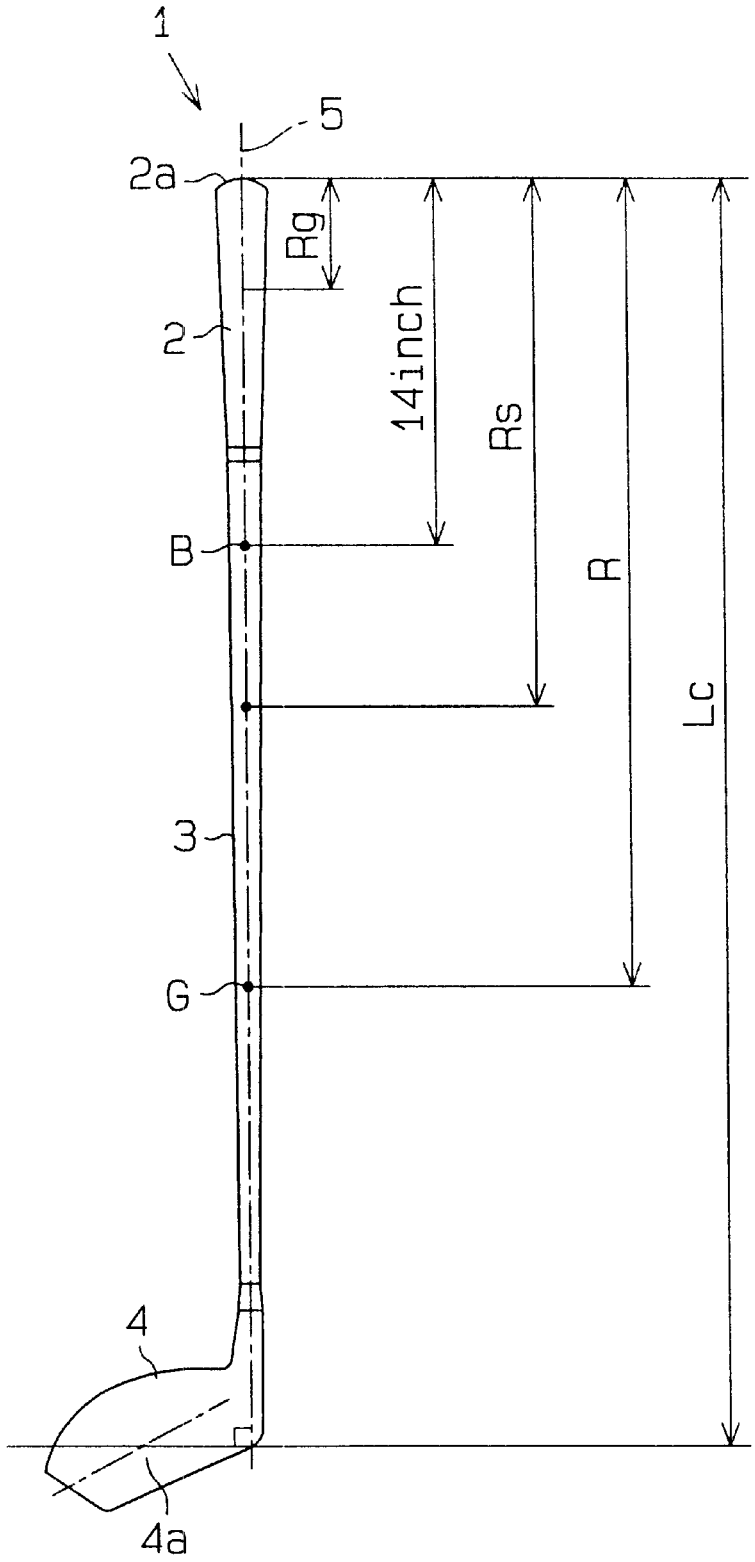
FIG. 1 illustrates a golf club of one embodiment of the invention.

FIG. 1 illustrates a golf club of one embodiment of the invention. The club 1 includes a shaft 3 having a tip end and a butt end, a grip 2, which is attached to the butt end, and a head 4, which is attached to the tip end. The mass distribution of the grip 2, the shaft 3 and the head 4 is determined by an indicator, which is a so-called "14-inch balance" or swing weight. Using the 14-inch balance, the mass distribution is determined by the moment of inertia on the axis between the upper end 2*a* of the grip and a point B that is spaced 14 inches (0.3556 m) from the upper end 2*a*. Although this indicator does not indicate the actual balance that a golfer feels during a swing, it is important in that the indicator evaluates the momental balances that a golfer feels at the particular moments such as at the address, at the backswing, and at the moment between the backswing and the downswing. Since advanced golfers generally prefer a club feeling that permits them to sense the club head, they use clubs that have a 14-inch balance of D0 or more as standards. "D0" refers to a balance in which X kg is applied to the upper end of the grip to make the point B the center of gravity of the club, and X=0.4323 kg. This balance is adjusted according to golfers' preferences. This invention applies to a club having a balance D0 or more but does not apply to a club having a balance below D0.

In this invention, the equivalent pendulum length Lp of the club 1 is an indicator of the swing characteristics of the club 1, and the initial velocity Vb of the ball is an indicator of the flying distance of the ball. To improve the swing characteristics while maintaining the high flying distance with less work, the relation between the equivalent pendulum length Lp and the initial velocity Vb is used. This facilitates the designing the club 1.

Firstly, the equivalent pendulum length Lp is explained. It is well known that a short equivalent pendulum length Lp improves the swing characteristics. This is explained further as follows.

When a golf swing is analyzed, it is understood that a golfer relaxes his wrists and decreases the angular velocity of his arms just before the ball impact. The motion of the club can be regarded as the swing of a pendulum around the golfer's wrists under the acceleration involved in the decrease of the angular velocity of the arms and the acceleration of gravity. The cycle of the pendulum is proportional to the pendulum length only. Thus, when the equivalent pendulum length Lp is short, the club speed around the wrists is fast.

Therefore, in order to improve the swing characteristics of the club, the equivalent pendulum length Lp must be decreased.

From an analysis of the actual swing, it is practical to take the rotation center of the club approximately at the upper end of the grip 2. Thus, as shown in FIG. 1, the location of the rotation center of the club is defined as the upper end 2*a* of the grip 2.

The equivalent pendulum length Lp (m) around the rotation center 5 is the moment of inertia I ($kgm^2$) around upper end 2*a* of the grip 2 divided by the club mass Mc (kg) and distances R (m) between the upper end 2*a* and the center of gravity G. The equivalent pendulum length Lp can be expressed by the following equation 2):

$$Lp=I/(Mc\cdot R) \quad 2)$$

Next, the flying distance is explained. It is widely known that the flying distance is determined by the initial velocity Vb of the ball after impact, flying angle with respect to the direction of gravity, other ball characteristics (e.g., the cross-sectional area, the ball spin, the coefficient of friction of air), and weather conditions (e.g., wind speed, wind direction, and air pressure).

The inventor conducted the following preliminary experiments to reveal the relation between the ball initial velocity Vb and the club mass Mc.

Figure 2:
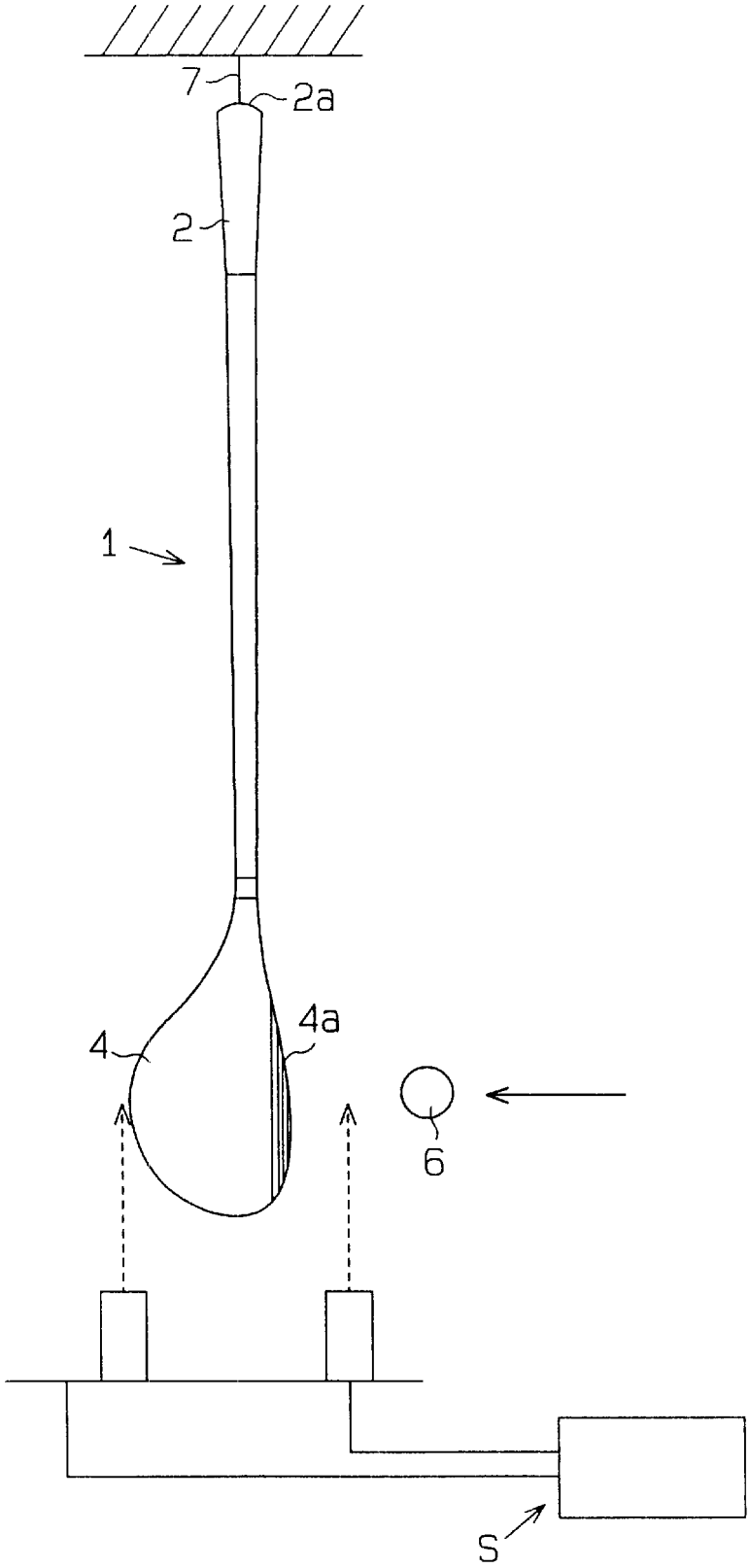
FIG. 2 is a diagrammatic view illustrating a system for measuring ball speed before and after impact and the head speed after impact in the perpendicular direction with respect to the impact face of the head by a speedometer S.

As shown in FIG. 2, the club 1 was hung by attaching a flexible string 7 to the upper end 2*a* of the grip 2 and fixing the upper end of the string 7 to a support. A ball 6 was struck with the impact face 4*a* (the so-called sweet spot) of the head 4 at a high speed. The speeds of the ball 6 before and after impact and the speed of the head 4 after impact in the perpendicular direction with respect to the impact face 4*a* of the head 4 were measured by a speedometer S.

From an analysis based on the results, it was found that the law of conservation of momentum applied between the ball speed before impact, the ball speed after impact, and the head speed after impact by using only three factors, namely, the head mass Mh, the ball mass Mb, and coefficient of restitution e of the head 4 and the ball 6. Therefore, the initial velocity Vb of the ball in the perpendicular direction with respect to the head impact face 4*a* was determined by the head speed Vh, the head mass Mh, the ball mass Mb, and the coefficient of restitution e of the head 4 and the ball 6*a*. The shaft mass, the stiffness of the shaft, the grip mass, and the torque applied at the moment of the impact did not affect the ball initial velocity Vb of the ball.

The ball initial velocity Vb (m/s) perpendicular to the head impact face 4*a* can be expressed by the following equation 3):

$$Vb=(Mh/(Mh+M))\times(1+e)\times Vh \quad 3)$$

where Mh is the head mass(kg), Mb is the ball mass(kg), e is the coefficient of restitution between the head 4 and the ball 6, Vh is the head speed perpendicular to the head impact face 4*a*.

When Mb=0.0455 (kg) and e=0.8, both of which are standard values, are assigned to equation 3), the ball initial velocity Vb can be written as follows:

$$Vb=1.8\ VhMh/(Mh+0.0455)\ 4)$$

This invention emphasizes on the mass distribution of the club 1 but does not consider the loft angle, which affects the performance of the head 4, the coefficient of restitution e, the ball mass Mb, which represents the characteristics of the ball 6, and the weather. Therefore, the flying distance can be evaluated from equation 4). Since the loft angle of the head 4 is ignored, the head speed Vh may be regarded as the head speed in its travelling direction, and the ball initial velocity Vb may be regarded as the ball initial velocity in its travelling direction.

To find the value of the head speed Vh, which is a coefficient in equation (4), the inventor measured the actual head speed of the different clubs by 100 randomly selected golfers. Ten clubs were tested including commercially available No.3, No.6, and No.9 irons and drivers.

A linear multiple regression analysis was then conducted to obtain the following equation 5). In the analysis, the average head speed Vh (m/s) of the resultant speeds of tested clubs was taken as a criterion variate and the total mass Mc (kg), equivalent pendulum length Lp (m), and club length Lc(m) of each club were taken as explanatory variates.

$$Vh=56.22\ Lc-35.16\ Mc-39.77\ Lp+31.61 \quad (5)$$

The coefficient of correlation between expected values and actual values in this equation was as high as 0.9997. The club length Lc is the distance from the upper end 2*a* of the grip to the perpendicular projection of the center of gravity of the head 4 as measured along the shaft axis (FIG. 1).

According to the equation 5), the head speed Vh increases if the club length Lc increases, the total mass of the club Mc decreases, and the equivalent pendulum length Lp decreases.

Thus, improved swing characteristics of the club contribute to an improvement in the head speed Vh. It is confirmed by equation 5) that a shorter equivalent pendulum length Lp is necessary to improve the swing characteristics of the club.

When the right side of equation 5) is substituted in equation 4), the following equation 1) is obtained.

$$Vb=1.8\ Mh(56.22\ Lc-35.16\ Mc-39.77\ Lp+31.61)/(Mh+0.0455)\quad 1)$$

Equation 1) shows that the ball initial velocity Vb is determined by the club length Lc, the total mass Mc of the club, and the mass distribution in the club.

When the mass distribution of the club 1 is such that the equivalent pendulum length Lp in equation 2) is short and the ball initial velocity Vb in equation 1) is large, i.e., when the mass distribution of the club is such that large Vb/Lp is large, the swing characteristics improve and the flying distance of the ball increases. Therefore, the following equation 6) was used as a final parameter in designing the clubs.

$$Vb/Lp=1.8\ Mh(McR(56.22\ Lc-35.16\ Mc+31.61)-39.77I)/(I(Mh+0.0455))\quad 6)$$

The ball initial velocity Vb of a first set of three different clubs that produce the good flying distance, and the equivalent pendulum length Lp of a second set of three different clubs that have the good swing characteristics but are inferior in terms of the flying distance, were calculated by equations 1) and 2) by experiments, respectively. Based on the resulting values of the ball initial velocity Vb and the equivalent pendulum length Lp, the relational equation 7) between the Vb/Lp and the club length Lc was obtained.

$$Vb/Lp=-3.57\ Lc+64.58\quad 7)$$

This indicates that a club having an initial velocity to equivalent pendulum length Vb/Lp ratio that is larger than −3.57 Lc+64.58 has improved swing characteristics and maintains the high ball flying distances.

In relation to the inventive club 1, which is D0 or more by 14-inch balance, the linear density ρ along the axis of the shaft 3 is determined to satisfy the inequality Vb/Lp>−3.57 Lc+64.58. If the mass of the grip 2, the shaft 3, and the head 4 are selected within normal ranges and the 14-inch balance of the club is D0 or more, it is understood from equation 1) that the ball initial velocity Vb will be large when the grip mass and the shaft mass are light and from equation 2) that the equivalent pendulum length Lp will be smaller when the grip mass and the shaft mass are heavy.

On the other hand, if the 14-inch balance is ignored, it is most effective to concentrate the shaft mass at the position 0.5 Lp as measured from the upper end 2*a* of the grip 2 to shorten the equivalent pendulum length Lp. This is confirmed by following calculations.

To a golf club having an equivalent pendulum length Lp=I/(Mc·R) is added a weight of the mass Mw at a distance x from the upper end 2*a* of the grip. The equivalent pendulum length Lp' after the weighting is:

$$Lp'=(I+Mw\cdot x^2)/(Mc\cdot R+Mw\cdot x)\quad A)$$

where Lp' has a maximum value at $$x=(-Mc\cdot R+\sqrt{(Mc^2\cdot R^2+Mw\cdot I)})/Mw\quad B)$$

Substituting the right side of equation B) into equation A) produces:

$$Lp'=2(-Mc\cdot R+\sqrt{(Mc^2\cdot R^2+Mw\cdot I)})/Mw=2x\quad (C)$$

This equation (c) shows that the position x of the weight that minimizes the equivalent pendulum length Lp' is a distance 0.5 Lp' from the upper end 2*a* of the grip.

The point that is 0.5 Lp' from the upper end 2*a* is located on the shaft 3. The total mass of the shaft 3 has a contrary effect on the ball initial velocity Vb and the equivalent pendulum length Lp. To improve these indicators, it is important for the linear density ρ of the shaft 3 to be concentrated at the position 0.5 Lp from the upper end 2*a*, regardless of the total mass of the shaft 3. The present invention is so embodied. The change in the shaft 3 is advantageous in that the shaft mass can be changed relatively freely and the change has less effect on the 14-inch balance.

The linear density ρ of the conventional shaft 3 is large at the butt end, which is where the grip 2 is located, or the tip end, which is where the head 2 is located and which is covered with high-impact reinforcements. A shaft 3 that has a the large linear density ρ only at the ends can not satisfy the inequality Vb/Lp>−3.57 Lc+64.58 while keeping 14-inch balance D0 or more. This is expected because the linear density ρ of such shaft is far different from that when the linear density ρ is concentrated at a position that is 0.5 Lp from the upper end 2*a* as described above.

The shaft of the club of the present invention may be manufactured by various processes such as a three-axis braiding process or a filament winding process.

The three-axis braiding process includes providing a mandrel and winding of first yarns, which extend longitudinally along the shaft, and second and third yarns, which are substantially symmetric relative to the first yarns. The second yarns extend in a different direction from the third yarns. The three types of yarns are braided together over the mandrel to form a layer.

The filament winding process includes providing a mandrel and winding yarns helically over the mandrel along the longitudinal shaft axis to form a layer.

EXAMPLES

As an example of a club embodying the invention, a No. 5 iron having a club length Lc of 0.965 m is described in detail.

A standard 51 g grip was selected as the grip 2, taking actual feeling that a golfer senses when holding the grip into account. The moment of inertia Ig of the grip 2 around the upper end 2*a* was 0.0009 ($kgm^2$). The distance Rg (FIG. 1) from the upper end 2*a* of the grip 2 to the center of gravity of the grip 2 was 0.1 (m).

Figure 3:
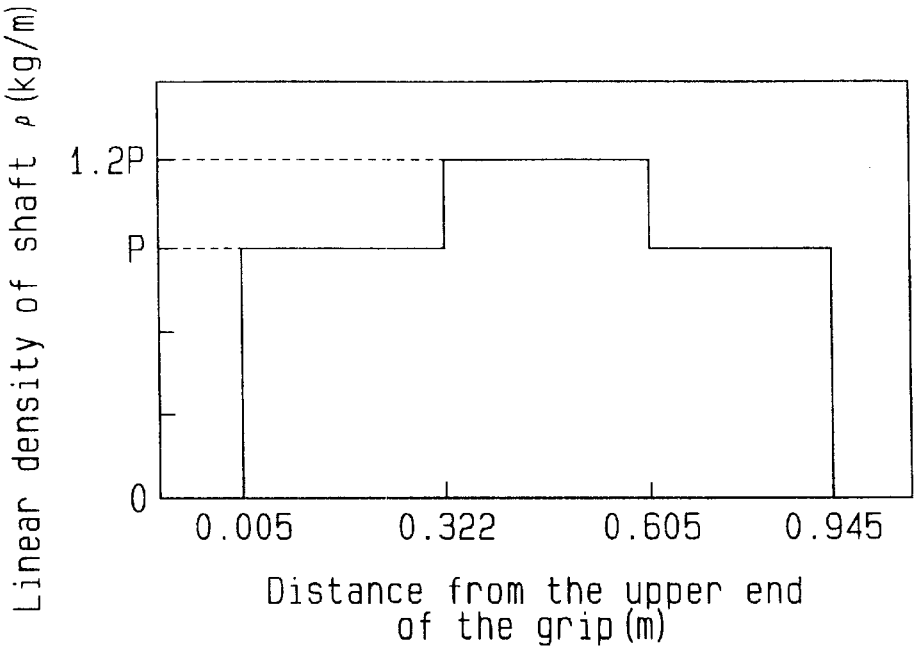
FIG. 3 is a graph showing a linear density ρ of the shaft of the club of one embodiment of the present invention.

As shown in FIG. 3, the linear density ρ of the shaft 3 was basically constant except for a middle section from 0.3185 to 0.6080 m, as measured from the upper end 2*a* of the grip 2. The middle section corresponded to 30% of the club length Lc, and the center of the middle section was located at the point that represent 48% of the club length Lc as measured from the upper end 2*a*. The linear density ρ of the middle section was increased by 20% compared to the remainder of the shaft 3. In other word, linear density ρ was 1.2 p (kg/m) in the middle portion of the graph, which corresponds to the middle section, and p (kg/m) at the other sections. The shaft 3 is defined to extend between a first point that is 5 mm from the upper end 2*a* of the grip 2 and a second point that is 20 mm less than the club length from the upper end 2*a*.

The moment of inertia Is of the shaft 3 around the upper end 2*a* of the grip 2 was as follows: 0.01077 p ($kgm^2$) in the upper section, from 0.005 to 0.3185 m, 0.07698 p ($kgm^2$) in the middle section, from 0.3185 to 0.6080 m, and 0.20638 p(kgm$^2$) in the lower section, from 0.6080 to 0.9450 m, as measured from the upper end 2*a*. The sum of the moment of inertia Is was 0.29413 p (kgm$^2$). The shaft mass Ms was as follows: 0.3135 p (kg) in the upper section, 0.3474 p (kg) in the middle section, and 0.337 p (kg) in the lower section. The sum of the shaft mass was 0.9979 p (kg). The distance Rs (FIG. 1) satisfied the following equation:

$$0.3135\ p(Rs-0.1618)+0.3474\ p\ (Rs-0.4632)+0.337\ p(Rs-0.7765)=0$$

When simplified, Rs=0.47432 (m).

Provided that the 14-inch balance of the club is D0 (X=0.4323 kg) and the head mass Mh is concentrated at the enter of gravity of the head 4, the head mass Mh satisfied the following equation:

$$0.4323(-0.3556)+0.051(0.1-0.3556)+0.9979\ p\ (0.474320-3556)+Mh(0.965-0.3556)=0$$

When simplified, Mh=0.27366–0.19440 p (kg). The moment of inertia Ih of the head 4 around the upper end 2*a* of the grip 2 was calculated to be 0.25484–0.18103 p (kgm$^2$) by substituting the above value of Mh into Mh×0.965$^2$.

The club mass Mc, the sum of the masses of the club elements, was 0.32466+0.80350 p (kg). The moment of inertia I around the upper end 2*a* of the grip, which is the sum of the moment of inertia of the club elements, was 0.25574+0.11310 p (kgm$^2$). The distance R (FIG. 1) satisfied the following equation:

$$0.051(R-0.1)+Ms(R-0.47432)+Mh(R-0.965)=0$$

When simplified, R=(0.26918+0.28572 p)/(0.32466+0.80350 p)(m).

The substitution of the calculated values into equation equation 6) resulted in:

$$Vb/Lp=(2.82452\ p^3-7.18436\ p^2+1.06295\ p+4.86134)/(-0.02199\ p^2-0.01362\ p+0.08162)$$

This equation makes it possible to express the initial velocity per equivalent pendulum length Vb/Lp as a function of the linear density p of the shaft.

Figure 5:
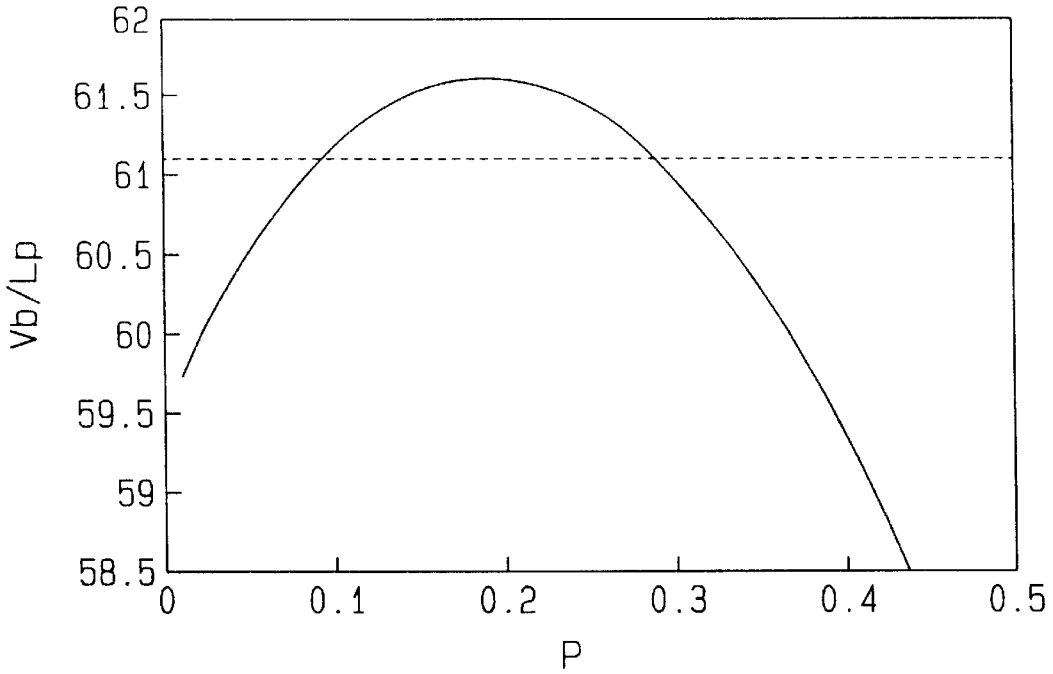
FIG. 5 is a graph of a ratio of initial velocity of a ball to equivalent pendulum length Vb/Lp expressed as a function of the linear density p of the shaft.

When Lc=0.965 was substituted in the right side of equation 7), the equation Vb/Lp=61.13 was given. The shaft of the present shaft should satisfy Vb/Lp>61.13. Therefore, when the right side of the above equation of Vb/Lp was substituded in this inequality, the linear density ρ satisfied the following inequality:

$$(2.82452\ p^3-7.18436\ p^2+1.06295\ p+4.86134)/(-0.02199\ p^2-0.01362\ p+0.08162)>61.13$$

whereby 0.094<p<0.289 was obtained (See FIG. 5).

At the same time, the head mass Mh was also defined as 0.2175<Mh<0.2554.

Thus, if a standard grip is used as a grip 2, the linear density ρ of the shaft 3 is distributed as in FIG. 3, and the 14-inch balance of the club is set at D0, the optimum mass distribution, which satisfies equation 7) can be determined.

Figure 4:
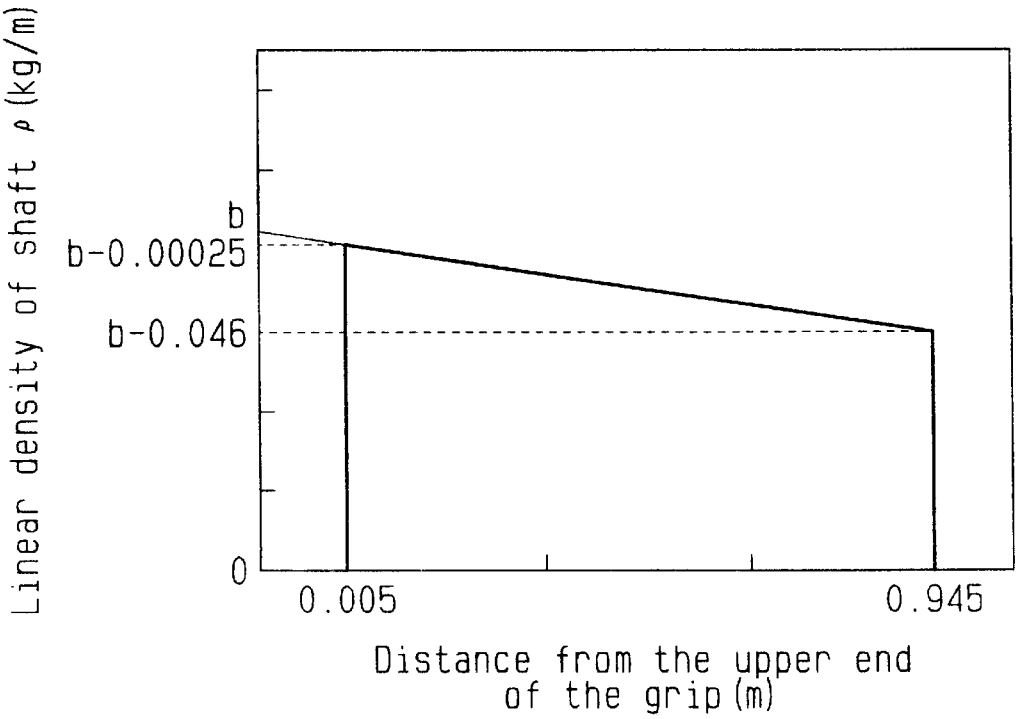
Fig.4(Prior Art)
FIG. 4 is a graph showing a linear density ρ of the shaft of a conventional club.

As shown in FIG. 4, the shaft mass of a conventional shaft, such as a normal graphite shaft, gradually decreases from the butt end toward the tip end. The linear density ρ can be expressed as ρ=−0.05x+b (x is the distance (m) from the upper end 2*a* of the club 1). When the club length Lc is 0.965(m), the standard 51 g grip is used, and 14-inch balance of the club is D0, the initial velocity per equivalent pendulum length Vb/Lp is Vb/Lp=61.11(b=0.210) at most. It is impossible for this club to satisfy formula 7).

Although it is preferred that the linear density ρ of the shaft 3 be concentrated at the position 0.5 Lp from the upper end 2*a* of the grip 2 as described above, to make the mass of parts at locations other than 0.5 Lp meters from the upper end 2*a* zero is impossible. In practice, it is important to distribute 32% or more of the total mass Ms of the shaft 3 in a range of 0.3 Lc around the location that is distance 0.5 Lp from the upper end 2*a* of the grip 2.

Further, when a weight is added to the position 0.5 Lp from the upper end 2*a* of the grip 2*a*, it is very effective to use, for weighting, fiber reinforced plastics (FRP) in which the reinforcing fibers are oriented at 90° relative to the shaft axis without changing the flexural rigidity EI of the shaft 1. To localize 32% or more of the total mass Ms of the shaft 3, it is preferred that 5% or more of the total mass Ms of the shaft 3 is formed by the reinforcing fibers oriented at 90° relative to the shaft axis.

The foregoing examples are applicable to all clubs having different club lengths. In addition, the initial velocity per equivalent pendulum length Vb/Lp can be used as an important factor to vary performances between clubs having different club numbers in a set of clubs.

In a typical set of clubs, both the ball initial velocity Vb and the equivalent pendulum length Lp increase as the club number decreases. Accordingly, a longer iron achieves a greater flying distance but is harder to swing. The initial velocity per equivalent pendulum length ratio Vb/Lp is reduced as the club number decreases. Particularly, the rate of change of the Vb/Lp ratio between two consecutive clubs increases as the number of the clubs decreases. In other words, the longer the club is, the worse the Vb/Lp ratio is. Therefore, the longer clubs are more difficult to handle.

In accordance with the present invention, the clubs in a set can be designed in various ways. For example, the Vb/Lp ratio of the club may be increased stepwise as the club length Lc decreases. The difference in the Vb/Lp ratio may be kept constant between consective clubs. Alternatively, the Vb/Lp ratio may be substantially the same among all or some of the clubs in the set. Thus, by selectively setting the Vb/Lp ratio among clubs having different club number, the balance of the clubs in a set may be adjusted appropriately.

Figure 6:
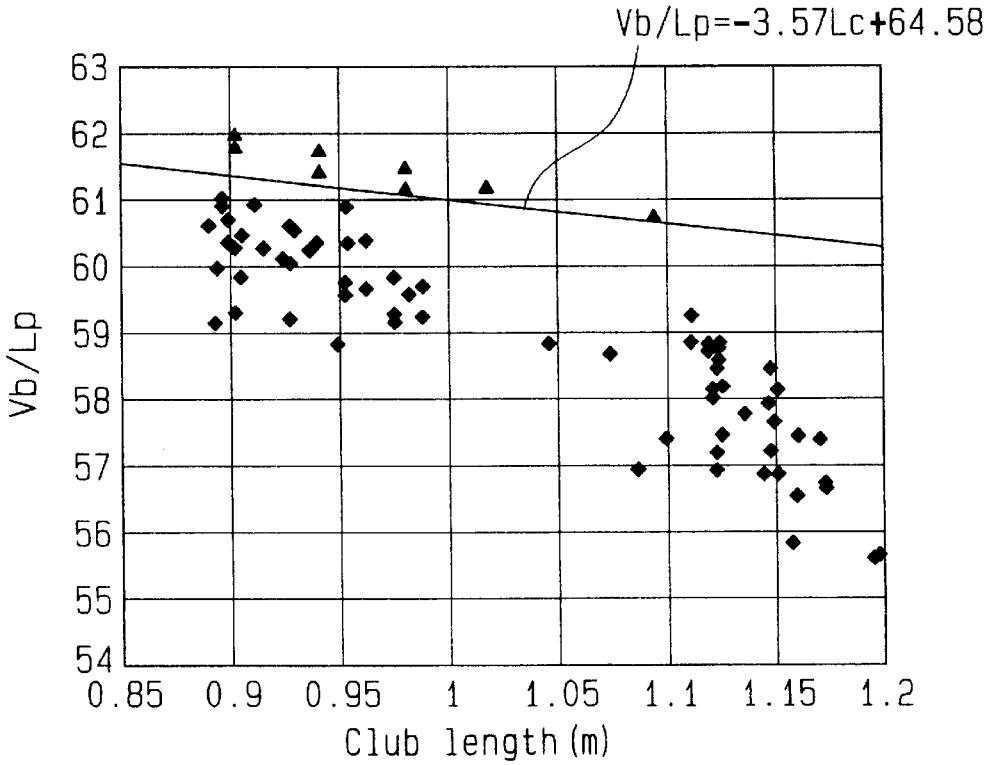
FIG. 6 is a boundary graph and distribution of the Vb/Lp of conventional clubs (diamonds) and that of inventive clubs (triangles)

FIG. 6 is a boundary graph and distribution of the Vb/Lp ratio of conventional clubs and inventive clubs. The diamonds represent conventional clubs and the triangles represent clubs of the present invention.

The club length Lc, the club mass Mc, the head mass Mh, the distance R from the of upper end of the grip to the center of gravity of the club, and the moment of inertia I around the upper end of the grip were measured for each club. The initial velocity per equivalent pendulum length Vb/Lp of the conventional clubs was then calculated by substituting these values in equation 6). The Vb/Lp ratio of the conventional clubs were plotted on the graph. The 14-inch balance of most of the clubs was D0.

In actual impact tests, good results for both the 30 swing characteristics and the flying distance were obtained only from clubs that had the Vb/Lp ratio larger than −3.57 Lc+64.58 among different tested clubs.

The present examples and embodiments are to be considered as illustrative and not restrictive and the invention is not to be limited to the details given herein, but may be modified within the scope and equivalence of the appended claims.

What is claimed is:

1. A golf club comprising:

a shaft having a tip end and a butt end;

a head attached to the tip end of the shaft;

a grip attached to the butt end of the shaft, wherein the 14-inch balance is D0 or more and the initial velocity per equivalent pendulum length Vb/Lp larger than −3.57 Lc+64.58, wherein Vb is the initial velocity of the ball, Lp is the equivalent pendulum length of the club when an upper end of the grip is taken as a rotation center, and Lc is the club length as measured from the upper end of the grip to a perpendicular projection of the center of gravity of the head along the axis of the shaft, wherein $$Vb=1.8\ Mh(56.22\ Lc-35.16\ Mc-39.77\ Lp+31.61)/(Mh+0.0455)$$

and Mh is the mass of the head (kg) and Mc is the total mass of the club (kg).

2. A golf club according to claim 1, wherein the mass of the shaft is concentrated at a distance 0.5 Lp from the upper end of the grip.

3. A golf club according to claim 2, wherein 32% or more of the total mass of the shaft is localized in a range of 0.3 Lc around a location that is distance 0.5 Lp from the upper end of the grip.

4. A golf club according to claim 3, wherein the shaft is formed of FRP including reinforcing fibers, wherein the reinforcing fibers are oriented at 90° relative to the shaft axis and 5% or more of the total mass of the shaft is formed by the reinforcing fibers so that 32% or more of the total mass of the shaft is localized.

5. A golf club according to claim 3, wherein the shaft is manufactured by a three-axis braiding process.

6. A golf club according to claim 3, wherein the shaft is manufactured by a filament process.

7. A golf club according to claim 1, wherein the shaft is formed of FRP.

8. A golf club according to claim 1, wherein the shaft is manufactured by a three-axis braiding process.

9. A golf club according to claim 1, wherein the shaft is manufactured by a filament winding process.

10. A set of golf clubs with different club lengths, each of the golf clubs comprising:

a shaft having a tip end and a butt end;

a head attached to the tip end of the shaft;

a grip attached to the butt end of the shaft, wherein the 14-inch balance is D0 or more and the initial velocity per equivalent pendulum length Vb/Lp larger than −3.57 Lc+64.58, wherein Vb is the initial velocity of the ball, Lp is the equivalent pendulum length of the club when an upper end of the grip is taken as a rotation center, and Lc is the club length as measured from the upper end of the grip to a perpendicular projection of the center of gravity of the head along the axis of the shaft, wherein $$Vb=1.8\ Mh(56.22\ Lc-35.16\ Mc-39.77\ Lp+31.61)/(Mh+0.0455)$$

and Mh is the mass of the head (kg) and Mc is the total mass of the club (kg).

11. A set of golf clubs according to claim 10, wherein the shaft of each club is formed of FRP.

12. A set of golf clubs according to claim 10, wherein the initial velocity per equivalent pendulum length Vb/Lp increases stepwise as the club length decreases.

13. A set of golf clubs according to claim 12, wherein the difference in the initial velocity per equivalent pendulum length Vb/Lp between consective clubs is constant.

14. A set of golf clubs with different club lengths, each of the golf clubs comprising:

a shaft having a tip end and a butt end;

a head attached to the tip end of the shaft;

a grip attached to the butt end of the shaft, wherein the 14-inch balance is D0 or more and the initial velocity per equivalent pendulum length Vb/Lp is larger than −3.57 Lc+64.58, wherein Vb is the initial velocity of the ball, Lp is the equivalent pendulum length of the club when an upper end of the grip is taken as a rotation center, and Lc is the club length as measured from the upper end of the grip to a perpendicular projection of the center of gravity of the head along the axis of the shaft, wherein Vb=1.8 Mh(56.22 Lc−35.16 Mc−39.77 Lp+31.61)/(Mh+0.0455) and Mh is the mass of the head (kg) and Mc is the total mass of The club (kg), and wherein the initial velocity per equivalent pendulum length Vb/Lp increases stepwise as the club length decreases.

15. A set of golf clubs according to claim 14, wherein the difference in the initial velocity per equivalent pendulum length Vb/Lp between consecutive clubs is constant.

16. A set of golf clubs according to claim 14, wherein the shaft of each club is formed of FRP.

* * * * *

UNITED STATES PATENT AND TRADEMARK OFFICE

CERTIFICATE OF CORRECTION

PATENT NO. : 6,478,689 B1
DATED : November 12, 2002
INVENTOR(S) : Hisamatsu, Goro It is certified that error appears in the above-identified patent and that said Letters Patent is hereby corrected as shown below:

Title page,
Item [73], Assignee should read

-- [73] Assignee: Mizuno Corporation, Osaka, (JP) --

Signed and Sealed this

Fourth Day of March, 2003

JAMES E. ROGAN
*Director of the United States Patent and Trademark Office*